US006971134B2

(12) United States Patent
Wu

(10) Patent No.: US 6,971,134 B2
(45) Date of Patent: Dec. 6, 2005

(54) INFLATABLE BED

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 10/914,102

(22) Filed: Aug. 10, 2004

(65) Prior Publication Data

US 2005/0229320 A1 Oct. 20, 2005

(30) Foreign Application Priority Data

Apr. 16, 2004 (CN) ..... 2004200089888 U

(51) Int. Cl.[7] ..... A47C 27/08
(52) U.S. Cl. ..... 5/712; 5/682; 5/711
(58) Field of Search ..... 5/711, 712, 706, 5/710, 713, 682, 683, 684, 655.3

(56) References Cited

U.S. PATENT DOCUMENTS 4,296,510 A * 10/1981 Phillips ..... 5/683
5,022,109 A * 6/1991 Pekar ..... 5/706
5,598,593 A * 2/1997 Wolfe ..... 5/710

* cited by examiner

*Primary Examiner*—Alexander Grosz

(74) *Attorney, Agent, or Firm*—Harness, Dickey & Pierce, P.L.C.

(57) ABSTRACT

An inflatable bed includes an envelope having first and second walls and a surrounding wall that cooperates with the first and second walls to define an air chamber, a flexible partition sheet disposed within the air chamber, a reinforcing sheet overlying the partition sheet and having a marginal end, a plurality of first retention members connected between the first wall of the envelope and the partition sheet, and a plurality of second retention members connected between the second wall of the envelope and the reinforcing sheet. The flexible partition sheet has a peripheral end welded to the surrounding wall and dividing the air chamber into first and second air chambers. The reinforcing sheet is welded to the partition sheet solely at the marginal end.

2 Claims, 4 Drawing Sheets

INFLATABLE BED

CROSS-REFERENCE TO RELATED APPLICATION

This application claims priority based on Chinese Application No. 2004200089888, filed on Apr. 16, 2004.

BACKGROUND OF THE INVENTION

1. Field of the Invention

The invention relates to an inflatable bed, more particularly to an inflatable bed having retention members in upper and lower air chambers and that is stable and safe to use.

2. Description of the Related Art

Referring to FIG. 1, a conventional inflatable bed 1 includes a bed body 11 and an air valve 12 provided on the bed body 11 for inflation and deflation of the bed 1. The bed body 11 includes bottom and top sheet layers 116, 117, a surrounding sheet 111 that interconnects the bottom and top sheet layers 116, 117 and that cooperates with the bottom and top sheet layers 116, 117 to confine an air chamber 112, a partition sheet 113 disposed within the air chamber 112 and connected to the surrounding sheet 111 so as to divide the air chamber 112 into upper and lower air chambers 1122, 1121, and a plurality of lower and upper retention members 114 disposed respectively between the bottom sheet layer 116 and the partition sheet 113 and between the top sheet layer 117 and the partition sheet 113. The partition sheet 113 is formed with at least one through hole 115 to permit circulation of air within the upper and lower air chambers 1122, 1121. Using an inflating device, air is introduced into the air chamber 112 through the air valve 12, and is distributed within the upper and lower air chambers 1122, 1121 via the through hole 115 so that the surrounding sheet 111, the partition sheet 113, and the lower and upper retention members 114 are stretched.

However, a drawback of the above conventional configuration is that, in actual use, that is, when a user gets onto the top sheet layer 117 of the bed body 11, the upper part of the bed body 11 tends to move. The movement induced at the upper part of the bed body 11 can be transmitted to the lower part of the bed body 11 through the upper and lower retention members 114 which are interconnected through the partition sheet 113. Therefore, the lower part of the bed body 11 is prone to displacement and is unstable.

To resolve the aforementioned drawback, it has been proposed to add a reinforcing unit to the bed body. As shown in FIG. 2, two sides of a bed body 21 are provided respectively with a reinforcing air cylinder 22, or as shown in FIG. 3, an air ring 24 is provided around a periphery of a bed body 23. Through the presence of the reinforcing air cylinders 22 or the air ring 24, a bottom face area of the bed body 21, 23 is increased so that the bed body 21, 23 is more stable. However, the volume of the bed body 21, 23 is significantly increased, thereby making the appearance of the bed body 21, 23 unappealing.

SUMMARY OF THE INVENTION

Therefore, the object of the present invention is to provide an inflatable bed that has a sturdy and stable structure.

According to this invention, an inflatable bed comprises an envelope, a flexible partition sheet, a reinforcing sheet, a plurality of first retention members, and a plurality of second retention members. The envelope has a first wall, a second wall opposite to the first wall, and a surrounding wall interconnecting the first and second walls and cooperating with the first and second walls to define an air chamber. The flexible partition sheet is disposed within the air chamber, and has a peripheral end welded to the surrounding wall and dividing the air chamber into first and second air chambers. The reinforcing sheet overlies the partition sheet, and has a marginal end. The reinforcing sheet is welded to the partition sheet solely at the marginal end. The first retention members are connected between the first wall of the envelope and the partition sheet. The second retention members are connected between the second wall of the envelope and the reinforcing sheet.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 4:
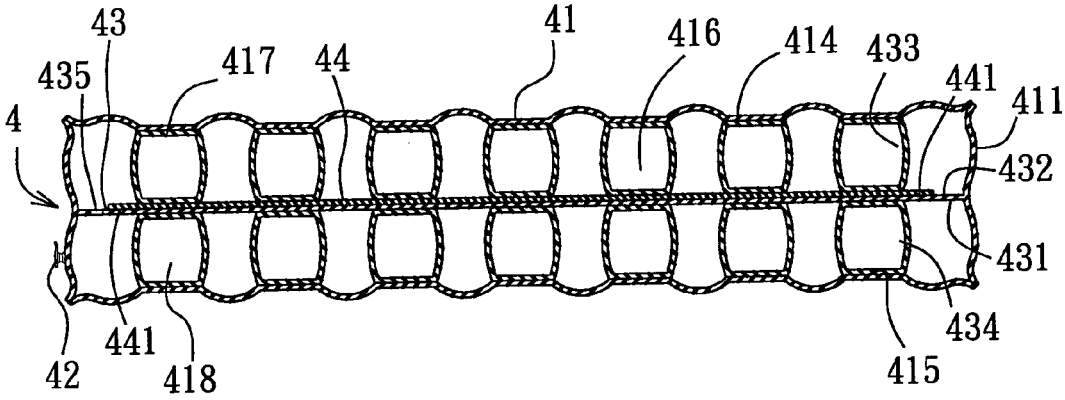
FIG. 4 is a sectional view of the preferred embodiment of an inflatable bed according to the present invention.
Figure 5:
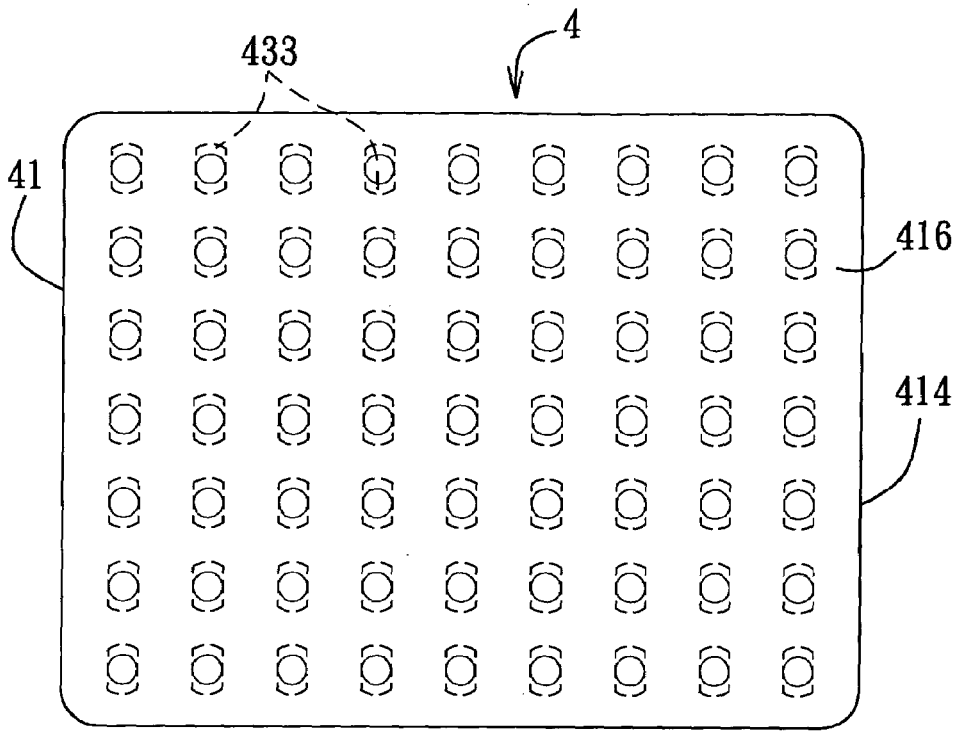
FIG. 5 is a schematic top view of the preferred embodiment.
Figure 6:
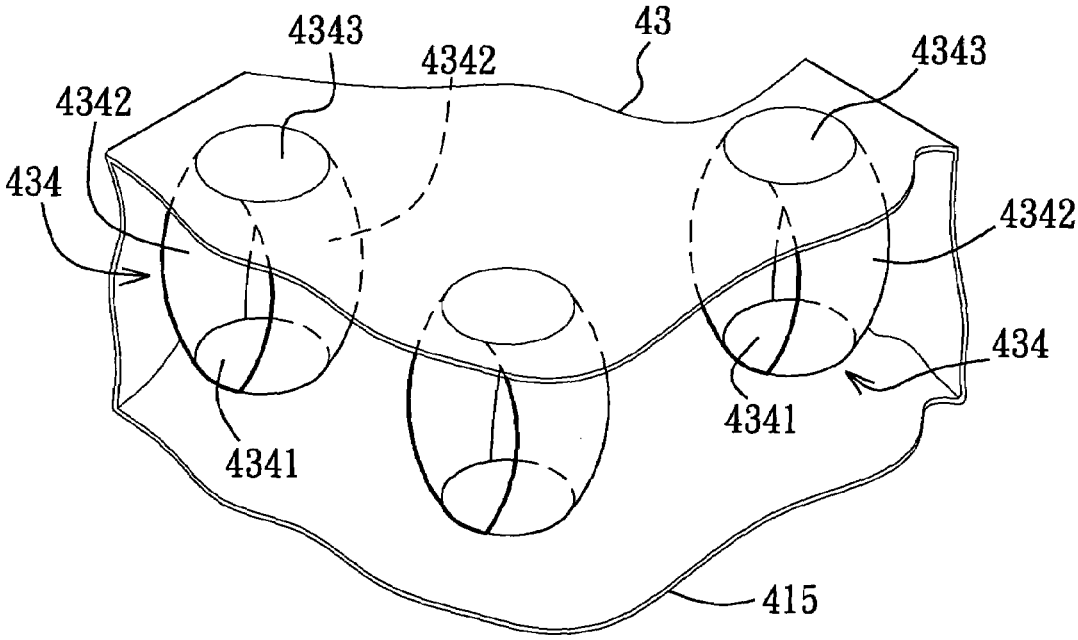
FIG. 6 is a fragmentary perspective view of the preferred embodiment, illustrating connection of second retention members between a second wall and a reinforcing sheet.

Referring to FIGS. 4 to 6, the preferred embodiment of an inflatable bed 4 according to the present invention is shown to comprise an envelope 41, an air valve 42, a flexible partition sheet 43, a reinforcing sheet 44, a plurality of first retention members 434, and a plurality of second retention members 433.

The envelope 41 has a first wall 415, a second wall 414 opposite to the first wall 415, and a surrounding wall 411 interconnecting the first and second walls 415, 414. The surrounding wall 411 cooperates with the first and second walls 415, 414 to define an air chamber 416.

The air valve 42 is provided on the envelope 41 for inflation and deflation of the inflatable bed 4.

The flexible partition sheet 43 is disposed within the air chamber 416, and has a peripheral end 431 welded to the surrounding wall 411 of the envelope 41. The partition sheet 43 divides the air chamber 416 into first and second air chambers 418, 417, and is formed with a plurality of through holes 435 (only one is shown in FIG. 4) to spatially intercommunicate the first and second air chambers 418, 417.

The reinforcing sheet 44 overlies the partition sheet 43, and has an area smaller than that of the partition sheet 43. The reinforcing sheet 44 has marginal ends 441, and is welded to the partition sheet 43 solely at the marginal ends 441. The remainder of the reinforcing sheet 44 is free of connection with the partition sheet 43.

In this embodiment, the first retention members 434 are in the form of coil-like beams, as best illustrated in FIG. 6. Each of the first retention members 434 has a bottom wall 4341, a top wall 4343 opposite to the bottom wall 4341, and two confronting side walls 4342 between the bottom and top walls 4341, 4343. The bottom and top walls 4341, 4343 are welded respectively to the first wall 415 of the envelope 41 and the partition sheet 43.

The second retention members 433, in this embodiment, are also in the form of coil-like beams, and are connected between the second wall 414 of the envelope 41 and the reinforcing sheet 44. Since the structure of the second retention members 433 is similar to that of the first retention members 434, and since the second retention members 433 are connected between the second wall 414 of the envelope 41 and the reinforcing sheet 44 in a similar manner to the way in which the first retention members 434 are connected, only a simple illustration of the same is provided in FIG. 5.

Figure 1:
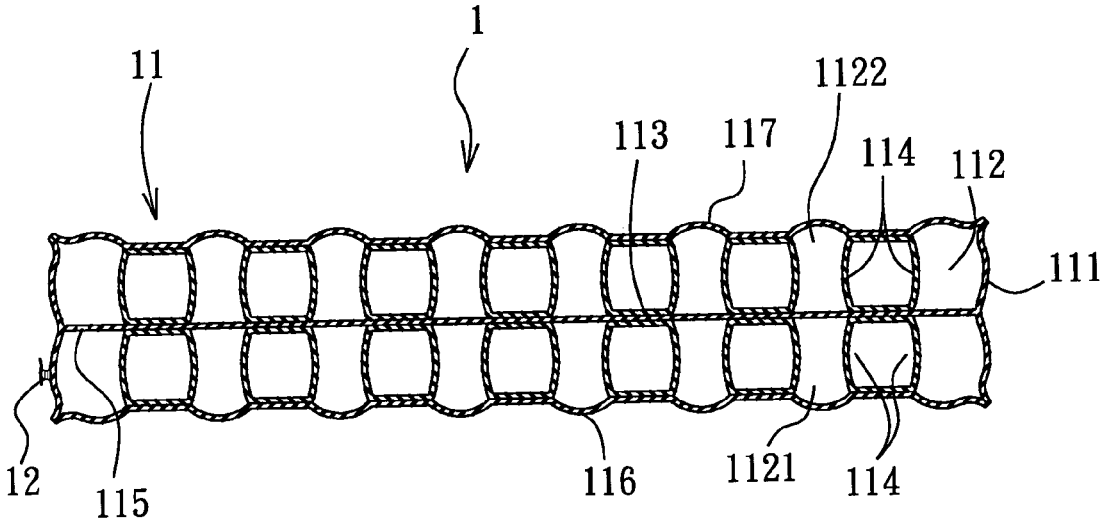
F I G. 1 PRIOR ART
FIG. 1 is a sectional view of a conventional inflatable bed.
Figure 2:
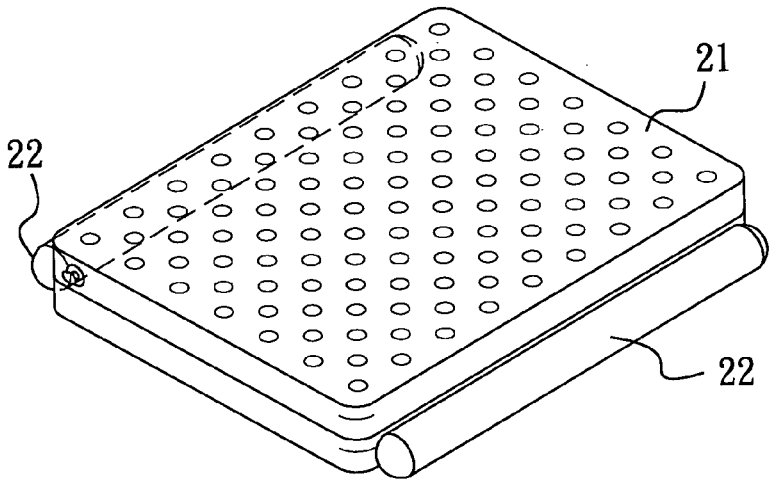
F I G. 2 PRIOR ART
FIG. 2 is a perspective view of another conventional inflatable bed.
Figure 3:
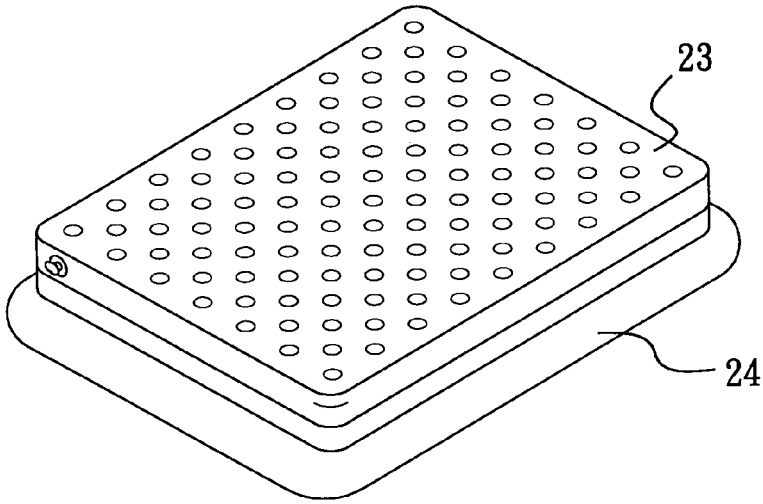
F I G. 3 PRIOR ART
FIG. 3 is a perspective view of yet another conventional inflatable bed.

When an inflating device is used to introduce air into the air chamber 416 through the air valve 42, air circulates within the first and second air chambers 418, 417 via the air holes 435, thereby inflating the envelope 41. The first retention members 434 are therefore stretched between the partition sheet 43 and the first wall 415 of the envelope 41, and the second retention members 433 are stretched between the reinforcing sheet 44 and the second wall 414 of the envelope 41. As all parts of the reinforcing sheet 44 other than the marginal ends 441 are disconnected from the partition sheet 43, the first and second retention members 434, 433 operate independently from each other. Therefore, when the upper part of the envelope 41, which is mostly composed of the second retention members 433, moves due to the weight of the user, the movement thereof is not transmitted to the first retention members 434 and the lower part of the envelope 41. The end result is that the inflatable bed 4 is able to withstand significant external forces, and is more stable compared to the conventional inflatable bed 1 of FIG. 1.

Figure 7:
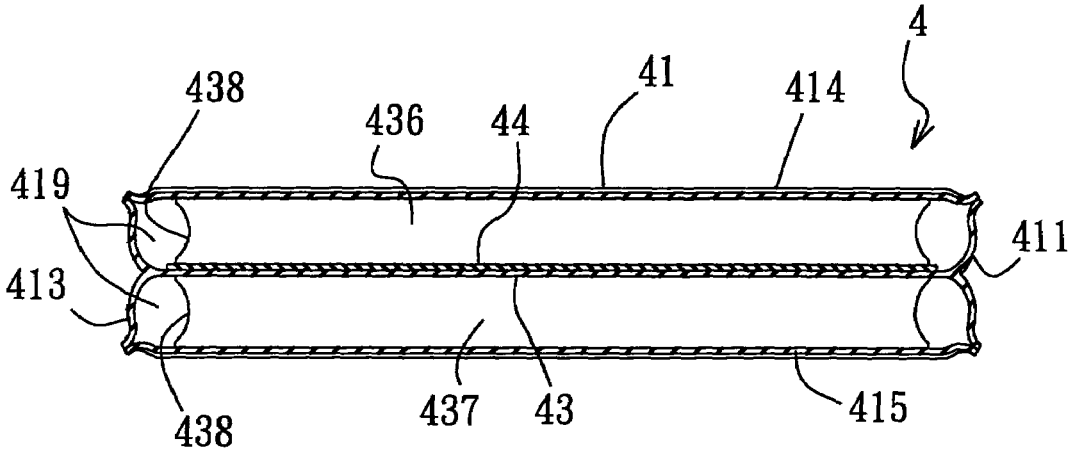
FIG. 7 is a sectional side view of the preferred embodiment, illustrating an alternative structure of first and second retention members.
Figure 8:
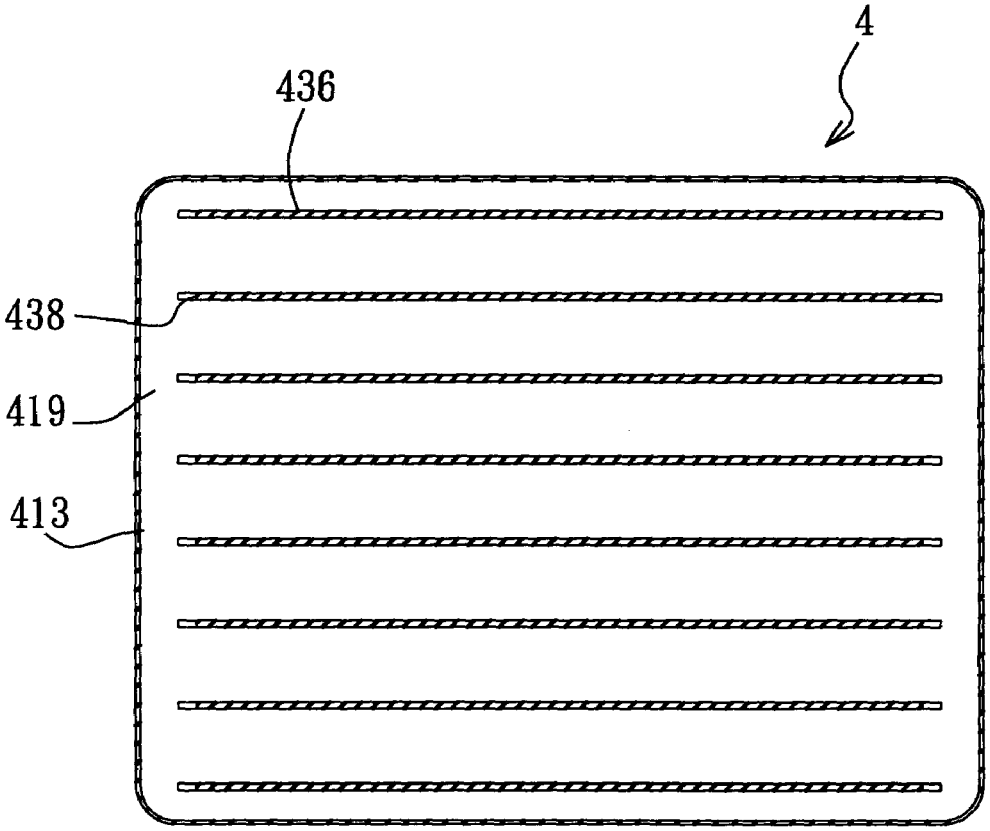
FIG. 8 is a sectional top view of FIG. 7.

Referring to FIGS. 7 and 8, the first and second retention members of the inflatable bed 4 according to the present invention may be configured as elongated I-beams 436, 437. Each end of the first and second retention members 437, 436 is formed with an indented edge 438. The first retention members 437 are welded to the first wall 415 of the envelope 41 and the partition sheet 43. The second retention members 436 are welded to the second wall 414 of the envelope 41 and the reinforcing sheet 44. The indented edges 438 of the first and second retention members 437, 436 cooperate with the surrounding wall 411 of the envelope 41 to form an air passage 419 so that air supplied into the inflatable bed 4 may flow into the first and second air chambers 418, 417 through the air passage 419.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An inflatable bed comprising:

an envelope having a first wall, a second wall opposite to said first wall, and a surrounding wall interconnecting said first and second walls and cooperating with said first and second walls to define an air chamber;

a flexible partition sheet disposed within said air chamber, and having a peripheral end welded to said surrounding wall and dividing said air chamber into first and second air chambers;

a reinforcing sheet overlying said partition sheet and having a marginal end, said reinforcing sheet being welded to said partition sheet solely at said marginal end, wherein said reinforcing sheet has an area smaller than that of said partition sheet;

a plurality of first retention members connected between said first wall and said partition sheet; and a plurality of second retention members connected between said second wall and said reinforcing sheet.

2. An inflatable bed comprising:

an envelope having a first wall, a second wall opposite to said first wall, and a surrounding wall interconnecting said first and second walls and cooperating with said first and second walls to define an air chamber;

a flexible partition sheet disposed within said air chamber, and having a peripheral end welded to said surrounding wall and dividing said air chamber into first and second air chambers, wherein said flexible partition sheet is formed with a plurality of through holes to spatially intercommunicate said first and second air chambers;

a reinforcing sheet overlying said partition sheet and having a marginal end, said reinforcing sheet being welded to said partition sheet solely at said marginal end;

a plurality of first retention members connected between said first wall and said partition sheet; and a plurality of second retention members connected between said second wall and said reinforcing sheet.

* * * * *